US006453879B2

(12) United States Patent
Joos et al.

(10) Patent No.: US 6,453,879 B2
(45) Date of Patent: Sep. 24, 2002

(54) OPERATING DEVICE FOR AN INTERNAL COMBUSTION ENGINE OF A MOTOR VEHICLE WITH A STARTER

(75) Inventors: Klaus Joos, Walheim; Jens Wolber, Gerlingen; Thomas Frenz, Noerdlingen; Markus Amler, Leonberg-Gebersheim, all of (DE); Hansjoerg Bochum, Novi, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/768,767

(22) Filed: Jan. 24, 2001

(30) Foreign Application Priority Data

Jan. 28, 2000 (DE) ..... 100 03 736

(51) Int. Cl.[7] ..... F02M 37/04
(52) U.S. Cl. ..... 123/497; 123/179.16
(58) Field of Search ..... 123/179.16, 179.17, 123/179.25, 495, 497

(56) References Cited

U.S. PATENT DOCUMENTS 4,893,593 A * 1/1990 Sejimo et al. ..... 123/179.25
5,158,051 A * 10/1992 Wada et al. ..... 123/179.15
5,233,952 A * 8/1993 Isaka ..... 123/179.17

OTHER PUBLICATIONS

Autoelektrik, Autoeleltronik, Vieweg Verlag, 1998, p. 191.

* cited by examiner

*Primary Examiner*—Thomas N. Moulis
(74) *Attorney, Agent, or Firm*—Michael J. Striker

(57) ABSTRACT

An operating device for an internal combustion engine of a motor vehicle with a starter having an electric motor, the operating device has a fuel pump; and a connection of said fuel pump with the electric motor so that the electric motor can be used additionally at least indirectly for driving of said fuel pump.

8 Claims, 1 Drawing Sheet

OPERATING DEVICE FOR AN INTERNAL COMBUSTION ENGINE OF A MOTOR VEHICLE WITH A STARTER

BACKGROUND OF THE INVENTION

The present invention relates to an operating device for an internal combustion engine of a motor vehicle with a starter.

Such operating devices with a starter are knowns from literature, Autoelectric, Autoelectronic Vieweg, Verlag, 1998, page 1, 91. The starter of the operating device has an electric motor. In the known operating device the electric motor is operated only over a short time for starting of the internal combustion engine, and during the operation of the internal combustion engine, no longer operates. The electric motor of the starter must be dimensioned sufficiently to guarantee a start of the internal combustion engine in any conditions. With the electric motor, thereby the weight of the motor vehicle is increased and it remains unused during the operation of the internal combustion engine. It is moreover known to use a fuel pump for a fuel injection device for an internal combustion engine, with which a predetermined injection pressure of the fuel is produced. Fuel pumps driven by an electric motor are used for low feeding pressure, and fuel pumps driven mechanically by the internal combustion engine are used for high feeding pressure. A high feeding pressure is required for example during direct injection of the fuel in the combustion chamber of the cylinder of the internal combustion engine. This is the case for a so-called gasoline-direct injection with separately ignited internal combustion engines.

SUMMARY OF THE INVENTION

Accordingly, it is an object of the present invention to provide an operating device of the above mentioned general type, in which the electric motor of the starter is used better and no drive for the fuel pump is needed.

In keeping with these objects and with others which will become apparent hereinafter, one feature of present invention resides, briefly stated, in an operating device of the above mentioned general type, in which the electric motor is used additionally at least indirectly for driving of a fuel pump.

When the operating device is designed in accordance with the present invention, it provides the above mentioned advantages and eliminates the disadvantages of the prior art.

The fuel pump can be a high pressure pump which produces a pressure of approximately 30 bar to 100 bar. Since the electric motor is dimensioned for starting of the internal combustion engine, it can be used for driving a fuel pump which produces a high feeding pressure, which is the case during a fuel injection directly into the combustion chamber of the cylinders of the internal combustion engine.

In accordance with a further feature of the present invention, the fuel pump, during the start of the internal combustion engine performed by the starter, can be uncoupled from the electric motor. Thereby for starting of the internal combustion engine, the total power of the electric motor is utilized.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
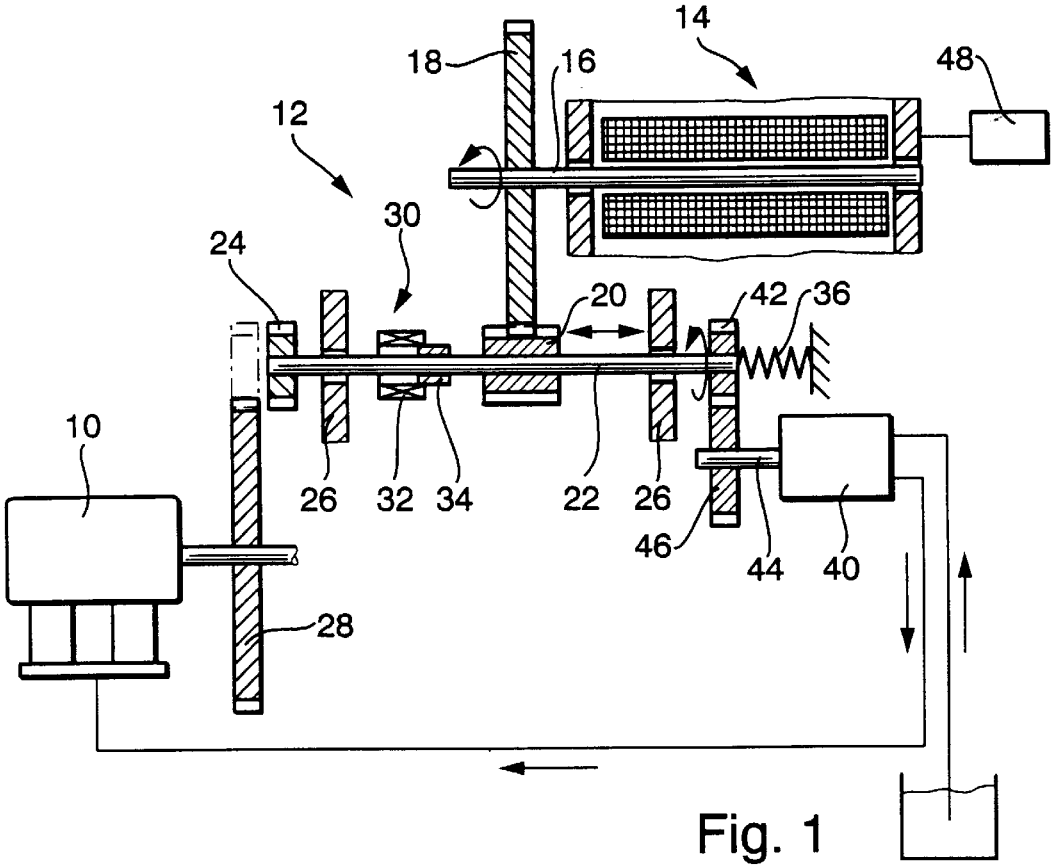
FIG. 1 is a view showing an operating device for an internal combustion engine of a motor vehicle in accordance with a first embodiment of the present invention.
Figure 2:
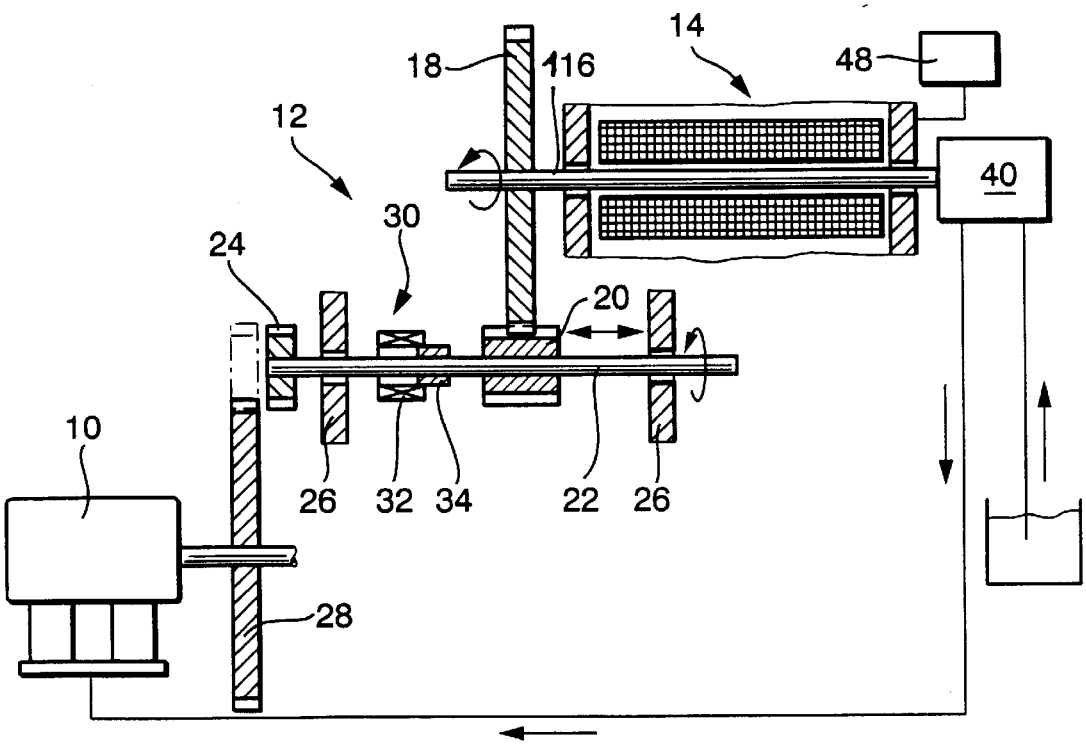
FIG. 2 is a view showing an operating device for an internal combustion engine of a motor vehicle in accordance with a second embodiment of the present invention.

An operating device for an internal combustion engine 10 of a motor vehicle is shown in FIGS. 1 and 2. The operating device has a starter 12, for setting the internal combustion engine 10 in operation. The starter 12 has an electric motor 14 which is dimensioned sufficiently for the internal combustion engine 10 to operate in all conditions. The electric motor 14 has a motor shaft 16 which is driven in a rotary movement when current is supplied to the electric motor 14. A toothed gear 18 is non rotatably mounted on the motor shaft 16. It engages with a toothed gear 20 with a substantially smaller diameter, formed as a pinion. The pinion 20 is non rotatably mounted on the shaft 22, which extends substantially parallel to the motor shaft 16 and is offset from it. A further toothed gear 24 with a smaller diameter is non rotatably connected with the shaft 22 and forms a starter pinion. The shaft 22 is rotatably supported on one or several bearing points 26.

The internal combustion engine 10 has for example a crankshaft, with which a toothed gear 28 is rotatably connected. It has a substantially greater diameter than the starter pinion 24. The starter 12 has an electromagnet 30, which displaces the shaft 22 in direction of its longitudinal axis. The electromagnet 20 has a coil 32 which surrounds the shaft 22, and an armature 34 arranged on the shaft 22. When current does not flow through the coil 32 of the electromagnet 30, the shaft 22 is located in the right position shown in FIG. 1, in which the starter pinion 24 does not engage the toothed gear 28 of the internal combustion engine 10. For starting the internal combustion engine 10, the electric motor 14 is set in operation and the coil 32 is supplied with current. When current flows through the coil 32, a magnetic field is produced, by which the armature 34 and thereby the shaft 22 is pulled into the coil 32. The shaft 22 is displaced to a left position shown in FIG. 1, in which the starter pinion 24 engages with a toothed gear 28 of the internal combustion engine 10. The shaft 22 is driven from the motor shaft 16 through the toothed gear 18 and the pinion 20, and the crankshaft of the internal combustion engine 10 is driven by the shaft 22 through the starter pinion 24 and the toothed gear 28. After starting of the internal combustion engine 10, the coil 32 of the electromagnet 30 becomes currentless and the shaft 22 is displaced by a return device, for example formed as a spring 36, to its right position in which the starter pinion 24 does not engage with the toothed gear 28. The electromagnet 30 can be arranged separately from the shaft 22. It activates, through a transmission device such as for example a lever, a displacement of the shaft 22.

The internal combustion engine 10 is for example an externally ignited internal combustion engine and has an injection device for injection of the fuel into the suction device or directly into the combustion chamber of the cylinder of the internal combustion engine 10. With the injection device, the fuel is injected under pressure, and a fuel pump 40 is provided for this purpose. When a fuel injection is performed in the initial position of the internal combustion engine 10, for this purpose only a small pressure is sufficient up to approximately 5 bar, which is produced by the fuel pump 40. When a fuel injection is performed directly into the combustion chamber of the cylinder of the internal combustion engine 10, for this purpose a higher pressure of approximately 30 to 100 bar is needed, which must be produced by the fuel pump 40. The fuel pump 40 can be formed as a flow pump or as a displacement pump. In accordance with the present invention, the fuel pump 40 does not have its own drive, but instead the electric motor 14 of the starter 12 at least indirectly is used for driving of the fuel pump 40.

FIG. 1 shows the operating device in accordance with a first embodiment for driving of the fuel pump. A toothed gear 42 is non rotatably mounted on the shaft 22 at its side which is opposite to the starter pinion 24 and forms a pump pinion. The fuel pump 40 has a drive shaft 44, with which a toothed gear 46 is non rotatably connected. When the shaft 22 is located in its right position shown in FIG. 1, the pump pinion 42 is in engagement with the toothed gear 46. When the electric motor 14 is in operation, the drive shaft 44 and thereby the fuel pump 40 is driven from the shaft 22 through the pump pinion 42 and the toothed gear 46, so that the fuel pump supplies fuel. The electric motor 14 during the operation of the internal combustion engine 10 is operated so as to maintain a fuel supply through the fuel pump 40. The operation of the electric motor 14 can be controlled or regulated by a control device 48. The rotary speed, with which the electric motor 14 is operated for driving of the fuel pump 40, can be different from the rotary speed with which the electric motor 14 is operated for starting of the internal combustion engine 10. When the electromagnet 30 is supplied with current for starting of the internal combustion engine 10, the shaft 22 is located in its left position shown in FIG. 1, so that the starter pinion 24 engages with the toothed gear 28, and the pump pinion 42 does not engage with the toothed gear 46, so that the fuel pump 40 is not driven.

The fuel consumption of the internal combustion engine 10 can be different depending on its operational parameters, so that the fuel quantity which must be supplied by the fuel pump 40 is not constant but instead is changeable. Also, the pressure with which the fuel is optimally injected can be different, depending on the operational parameters of the internal combustion engine 10. It can be provided that with the control device 48, the electric motor 14 is operated so that the fuel pump 40 feeds the required fuel quantity, and/or produces the required pressure. With the control device 48, the electric motor 14 can be operated for variation of the rotary speed of the fuel pump 40 and thereby the fuel feeding quantity and/or pressure, for example can be operated in a cyclical manner.

The electromagnet 30 forms the coupling device which selectively with the current provides the drive of the internal combustion engine 10 for starting by the electric motor 14, and in the condition without current makes possible driving of the fuel pump 40 during the operation of the internal combustion engine 10 by the electric motor 14. The motor shaft 16 with a toothed gear 18, the shaft 22 with the pinion 20, and the pump pinion 42 and the drive shaft 44 with the toothed gear 46 form a transmission device for transmission of the rotary movement of the electric motor 14 and for driving of the fuel pump 40.

FIG. 2 shows the operating device in accordance with the second embodiment for driving of the fuel pump 40. The construction of the starter 12 is substantially similar to that of the first embodiment. The electric motor 14 is in engagement with pinion 20 through the toothed gear 18 arranged on its motor shaft 116. The pinion 20 drives the shaft 32 which with the current-supplied electromagnet 30 engages through the starter pinion 24 with a toothed gear 28, which in turn drives the crankshaft of the internal combustion engine 10. The motor shaft 116 extends from the electric motor 14 at the side which is opposite to the toothed gear 18 and serves as a drive shaft for the fuel pump 40. The fuel pump 40 can be arranged substantially coaxially with the motor shaft 116 or offset relative to the motor shaft 116. Then a transmission device for the rotary movement of the motor shaft 116 to a drive shaft of the fuel pump 40 is provided, for example in form of a gear transmission, a belt or a chain transmission. With the operating device in accordance with the second embodiment, the fuel pump 40 can be driven continuously, also during the start of the internal combustion 10 via the starter 12.

The electric motor 14 is operated with the voltage from the board battery of the motor vehicle, which is operated conventionally with 12 volt. It is especially advantageous for the above described drive of the fuel pump 40 when the vehicle is provided with a board battery with a voltage of approximately 42 volts for the operation of the electric motor 14.

It will be understood that each of the elements described above, or two or more together, may also find a useful application in other types of constructions differing from the types described above.

While the invention has been illustrated and described as embodied in operating device for an internal combustion engine of a motor vehicle with a starter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An operating device for an internal combustion engine of a motor vehicle with a starter having an electric motor, the operating device comprising a fuel pump; and means for operating said fuel pump from the electric motor so that the electric motor can be used additionally at least indirectly for driving of said fuel pump, said means being formed so that said fuel pump during a start of the internal combustion engine produced by the starter is decouplable from the electric motor.

2. An operating device as defined in claim 1, wherein said fuel pump is a high pressure pump producing a pressure from substantially 30 bar to substantially 100 bar.

3. An operating device as defined in claim 1, wherein said means is formed so that said fuel pump is permanently drivable by the electric motor.

4. An operating device as defined in claim 1, wherein said means is formed so that the fuel pump is directly drivable by said electric motor.

5. An operating device as defined in claim 1, wherein said means is formed as a transmission device through which said fuel pump is driven by said electric motor.

6. An operating device for an internal combustion engine of a motor vehicle with a starter having an electric motor, the operating device comprising a fuel pump; and means for operating said fuel pump from the electric motor so that the electric motor can be used additionally at least indirectly for driving of said fuel pump; and a coupling device which selectively allows either a drive of the internal combustion engine for starting by the electric motor or a drive of said fuel pump during an operation of the internal combustion engine by said electric motor.

7. An operating device for an internal combustion engine of a motor vehicle with a starter having an electric motor, the operating device comprising a fuel pump; and means for operating said fuel pump from the electric motor so that the electric motor can be used additionally at least indirectly for driving of said fuel pump; and means providing driving of said fuel pump by the electric motor with a different rotary speed than for starting of the internal combustion engine.

8. An operating device as defined in claim 7, wherein said providing means is formed so that the electric motor for driving of said fuel pump is operated with such changeable rotary speed as to produce by said fuel pump a predetermined parameter selected from the group consisting of a fuel quantity and a fuel pressure.

* * * * *